US010334337B2

(12) United States Patent
Warden et al.

(10) Patent No.: US 10,334,337 B2
(45) Date of Patent: Jun. 25, 2019

(54) SPEAKER

(71) Applicant: Bose Corporation, Framingham, MA (US)

(72) Inventors: Robert A. Warden, Southborough, MA (US); Kevin Joseph Brousseau, Newton, MA (US); Randy J. Kulchy, Shrewsbury, MA (US); Benjamin C. Lippitt, Worcester, MA (US)

(73) Assignee: Bose Corporation, Framingham, MA (US)

( * ) Notice: Subject to any disclaimer, the term of this patent is extended or adjusted under 35 U.S.C. 154(b) by 353 days.

(21) Appl. No.: 15/046,915

(22) Filed: Feb. 18, 2016

(65) Prior Publication Data

US 2017/0245033 A1 Aug. 24, 2017

(51) Int. Cl.
*H04R 1/02* (2006.01)

(52) U.S. Cl.
CPC ..... *H04R 1/026* (2013.01); *H04R 1/025* (2013.01); *H04R 1/023* (2013.01)

(58) Field of Classification Search
CPC ..... H04R 1/026; H04R 2201/025; H04R 1/02
See application file for complete search history.

(56) References Cited

U.S. PATENT DOCUMENTS 3,404,425 A * 10/1968 Wilder ..... A47B 81/06 16/30
4,253,368 A * 3/1981 Leslie ..... G10H 1/047 181/143
5,163,167 A 11/1992 Heil
5,602,366 A 2/1997 Whelan et al.
5,758,852 A * 6/1998 Martin ..... H04R 1/026 181/199
5,996,728 A * 12/1999 Stark ..... H04R 1/028 181/144
6,536,554 B2 3/2003 Andrews et al.
6,640,924 B2 11/2003 Messner
6,652,046 B2 11/2003 Christner
6,999,597 B2 * 2/2006 Yang ..... H04R 1/02 181/145

(Continued)

FOREIGN PATENT DOCUMENTS

CN 2927574 Y 7/2007
CN 103037284 A 4/2013

(Continued)

OTHER PUBLICATIONS

VTX V20 Specsheet, High Performance Dual 10" Line Array Element, JBL Professional by Harman © 2015 Harman International Industries, Incorporated, May 12, 2015.

*Primary Examiner* — Oyesola C Ojo
(74) *Attorney, Agent, or Firm* — Brian M. Dingman; Dingman IP Law, PC

(57) ABSTRACT

A speaker includes a housing, a member secured to the housing, and a locking pin which passes through a first portion of the speaker. The member substantially covers at least two sides of the locking pin. The member thus provides some protection against the locking pin unintentionally coming into contact with another object. The member has two or more feet which are secured to the member and which can support the speaker on a substantially horizontal surface when the speaker is oriented such that the member is facing the surface.

17 Claims, 2 Drawing Sheets

(56) References Cited

U.S. PATENT DOCUMENTS

| | | | | |
|---|---|---|---|---|
| 7,036,781 | B1 | 5/2006 | Bothe | |
| 7,261,180 | B1 | 8/2007 | Faranda et al. | |
| 7,298,860 | B2 | 11/2007 | Engebretson et al. | |
| 7,328,769 | B1 | 2/2008 | Adamson | |
| 7,516,932 | B2 | 4/2009 | Engebretson et al. | |
| 7,634,100 | B2 * | 12/2009 | Monitto | H04R 1/026 381/335 |
| 7,693,296 | B2 | 4/2010 | Monitto et al. | |
| 7,894,182 | B2 * | 2/2011 | Wang | G06F 1/1605 349/56 |
| 7,967,103 | B2 * | 6/2011 | Bothe | H04R 1/403 181/199 |
| 7,995,786 | B2 * | 8/2011 | Yu | H04R 1/025 381/333 |
| 7,997,552 | B2 | 8/2011 | Engebretson et al. | |
| 8,116,505 | B2 * | 2/2012 | Kawasaki-Hedges | H04R 5/02 381/386 |
| 8,130,996 | B2 | 3/2012 | Kling et al. | |
| 8,165,334 | B2 | 4/2012 | Iwayama | |
| 8,170,263 | B2 * | 5/2012 | Engebretson | H04R 1/026 381/335 |
| 8,254,623 | B2 * | 8/2012 | Okumura | H04N 5/642 381/388 |
| 8,540,199 | B2 * | 9/2013 | Ke | G12B 9/08 181/199 |
| D692,863 | S | 11/2013 | Givre et al. | |
| D692,864 | S | 11/2013 | Givre et al. | |
| D692,865 | S | 11/2013 | Givre et al. | |
| 8,590,666 | B2 | 11/2013 | Adamson et al. | |
| 8,600,097 | B2 * | 12/2013 | McGhee | H04R 1/02 181/198 |
| D698,336 | S | 1/2014 | Givre et al. | |
| 8,807,270 | B2 | 8/2014 | Givre | |
| 8,842,867 | B2 | 9/2014 | Bothe | |
| 8,913,778 | B2 * | 12/2014 | Mitsuhashi | H04R 1/028 381/395 |
| 9,432,757 | B2 * | 8/2016 | Faranda | H04R 1/026 |
| 9,541,951 | B2 * | 1/2017 | Kita | G06F 1/1601 |
| 9,591,778 | B1 * | 3/2017 | Mercier | G06F 1/16 |
| 2003/0059077 | A1 * | 3/2003 | Kambe | H04R 1/02 381/333 |
| 2006/0210095 | A1 * | 9/2006 | Monitto | H04R 1/028 381/87 |
| 2006/0256976 | A1 | 11/2006 | House | |
| 2008/0170729 | A1 | 7/2008 | Lissaman et al. | |
| 2010/0215205 | A1 * | 8/2010 | Nagao | A47B 81/06 381/388 |
| 2012/0189420 | A1 | 7/2012 | Kemper et al. | |
| 2013/0107140 | A1 * | 5/2013 | Kita | G06F 1/1601 348/836 |
| 2013/0182884 | A1 * | 7/2013 | Mitsuhashi | H04R 1/028 381/395 |
| 2013/0208936 | A1 | 8/2013 | McGhee et al. | |
| 2014/0205132 | A1 | 7/2014 | Spillmann et al. | |
| 2014/0301580 | A1 | 10/2014 | Andrews et al. | |
| 2014/0307907 | A1 * | 10/2014 | Takeuchi | H04R 1/02 381/334 |
| 2014/0353074 | A1 | 12/2014 | Bridge et al. | |
| 2017/0055701 | A1 * | 3/2017 | Latvis, Jr. | A47B 47/0083 |

FOREIGN PATENT DOCUMENTS

| | | | | |
|---|---|---|---|---|
| DE | 102012110648 | A1 | 5/2014 | |
| GB | 2512690 | A | 10/2014 | |
| JP | 2004336433 | * | 11/2004 | H04N 5/64 |

* cited by examiner

SPEAKER

BACKGROUND

This disclosure relates to speakers.

U.S. Pat. No. 7,634,100 discloses a side frame for a loudspeaker rigging system with a frame structure mountable to the side of a loudspeaker. Links associated with the frame structure link together the corners of the frame structures of vertically adjacent side frames. The links associated with each side frame structure include a pivot link and splay adjustment link, each of which has a top extended end and a base end with a seating edge. Guide channels, which are located in the top corner regions of the frame structure to receive the base ends of a pivot link and splay adjustment link associated with a vertically adjacent side frame, have seating surfaces that conform to the seating edges at the base ends of the pivot and splay adjustment link.

When base ends of these links seat in the guide channels, pin holes in the base end of the links self-align with pin holes in the corners of the frame structure for easy insertion locking pins. The extended end of the splay adjustment link further includes at least two, and preferably an array of pin holes which can selectively be matched with one pin hole within a row of pin holes in a bottom corner region of the side frame to permit adjustments of the splay angle over a range of angles. Suitably, two rows of pin holes are provided in the top extended end of the splay adjustment link to permit multiple and incrementally small splay angle adjustments. In the preferred embodiment, the frame structure is comprised of an assembly of parts comprised of a center core structure sandwiched between two side plates.

An issue with this arrangement is that the locking pins 42-46 project from a side of the speaker and can become damaged or snagged, or injure a person when they unintentionally come into contact with an object or person. Additionally, the speaker cannot be placed on its side (which may be desirable during transport, setup or breakdown of a speaker system) because the locking pins may become damaged. Finally, the frame structure 12 covers only roughly half of the side of the speaker which can allow the uncovered side portion of the speaker to get damaged if it is unintentionally struck with another object.

SUMMARY

In one aspect, a speaker includes a housing, a member secured to the housing, and a locking pin which passes through a first portion of the speaker. The member substantially covers at least two sides of the locking pin. The member thus provides some protection against the locking pin unintentionally coming into contact with another object. The member has two or more feet which are secured to the member and which can support the speaker on a substantially horizontal surface when the speaker is oriented such that the member is facing the surface Implementations may include one of the following features, or any combination thereof. The member is releasably secured to a side portion of the housing. The member defines a handle which is unitary and integral with the member and which can be gripped by a human hand to lift the speaker. The member defines a pair of handles which can alternately be gripped by a human hand, depending on the orientation of the speaker, to lift the speaker. The member covers a substantially major portion of an exterior surface of a panel of the housing to protect the panel from damage. The locking pin passes through one of a plurality of through holes in an adjustable second portion of the speaker.

In another aspect, an end cap for a speaker includes a member which can be secured to a speaker housing. The member substantially covers at least two sides of a locking pin which passes through a first portion of the speaker when the member is secured to the housing. The member thus provides some protection against the locking pin unintentionally coming into contact with another object. The locking pin passes through one of a plurality of through holes in an adjustable second portion of the speaker.

Implementations may include one of the above features, or any combination thereof.

In yet another aspect, an end cap for a speaker includes a member which can be secured to a side of a speaker housing. Two or more feet are secured to the member and can support the speaker on a substantially horizontal surface when the speaker is oriented on its side such that the member is facing the surface.

Implementations may include one of the above features, or any combination thereof.

All examples and features mentioned above can be combined in any technically possible way. Other features and advantages will be apparent from the description and the claims.

DESCRIPTION

The description below describes a speaker in which end caps are secured to the speaker in order to protect portions of the speaker from unintentionally coming into contact with other objects. These other objects could become snagged on the speaker and/or damage the speaker. The end caps include feet which allows the speaker to be stood on its side without damaging the speaker side. In one example the end cap defines a handle which can be gripped in order to lift the speaker.

Figure 1:
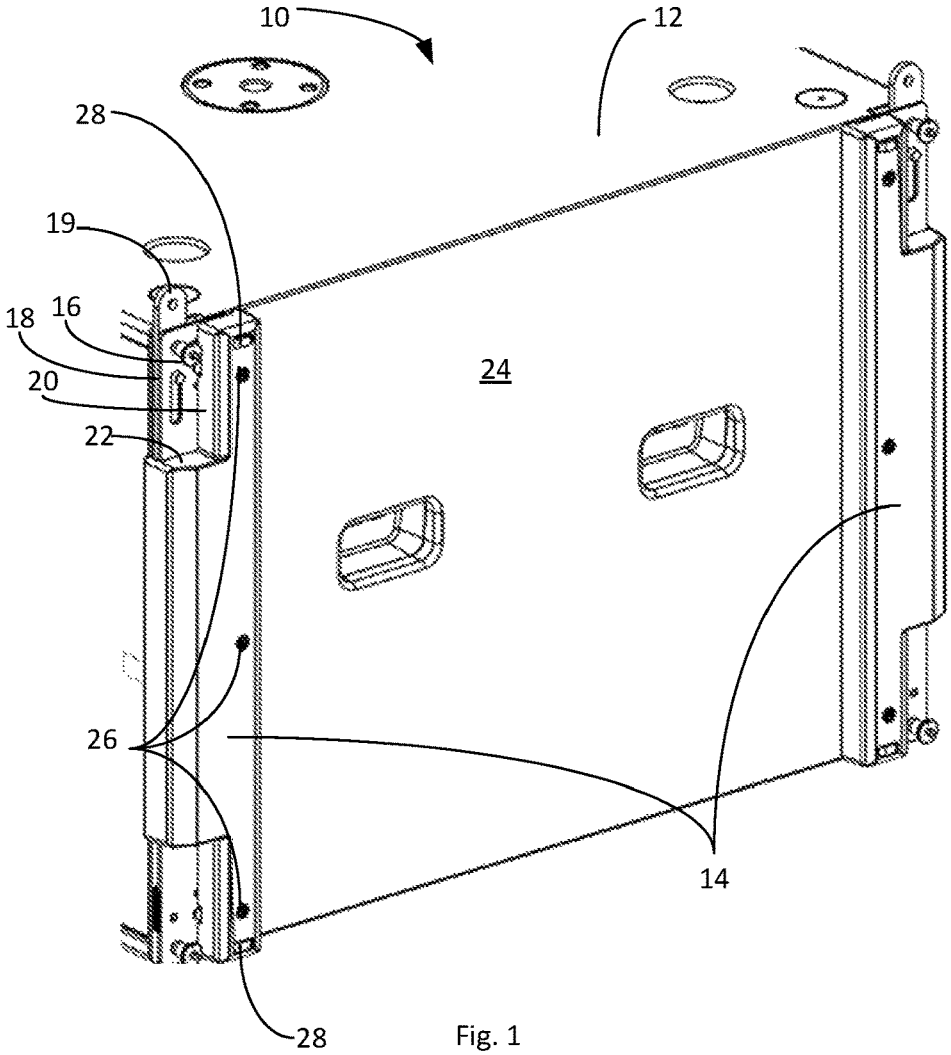
FIG. 1 shows a partial perspective view of a first example of a speaker with a pair of end caps secured to the speaker.
Figure 2:
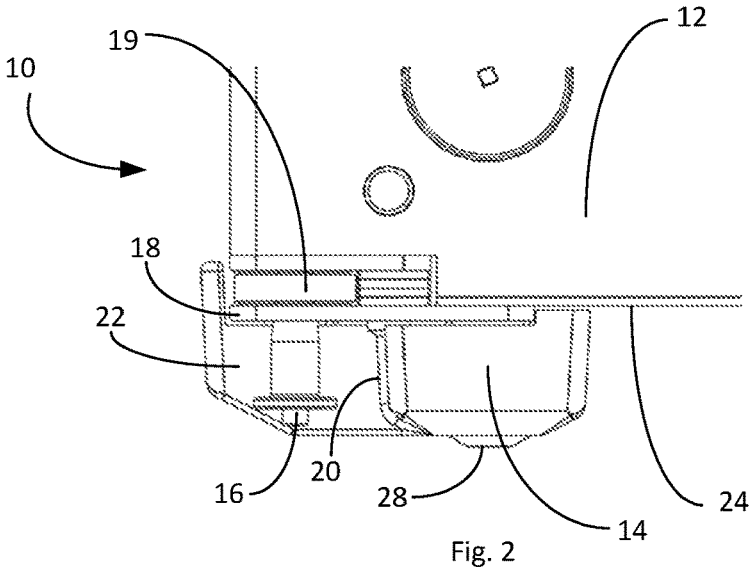
FIG. 2 is a top view of FIG. 1.

Referring to FIGS. 1 and 2, a speaker 10 includes a housing 12, and end caps in the form of members 14, preferably made of plastic, which are secured to the housing. In this example the speaker 10 is a sub-woofer. A locking pin (e.g. a quick pin) 16 passes through a first portion 18 of the speaker 10 and through one of a plurality of through holes in an adjustable second portion of the speaker in the form of an attachment bar 19. The bar 19 is used to connect the speaker 10 to another object such as another speaker or a frame.

The member 14 substantially covers at least two sides of the locking pin 16. In this case, surfaces 20 and 22 of the member 14 cover respective sides of the locking pin 16. In other examples a member can be constructed to cover three or all four sides of the locking pin. In this way the member 14 provides some protection against the locking pin 16 unintentionally coming into contact with another object.

Each member 14 is releasably secured to a side portion 24 of the housing 12 by, for example, a set of three screws 26. The members 14 are used when the speaker 10 will be moved around a lot (e.g. with a traveling band). That is because there is higher risk of the locking pins unintentionally contacting another object. If the speaker 10 will be set up permanently in one location, the members 14 can be removed from the speaker and stored as the risk is lower that the locking pins will unintentionally contact another object. In this case, the width of the speaker is reduced, thereby allowing the speaker to fit into smaller and tighter spaces (particularly if lower profile locking pins are used).

A pair of feet 28 are secured to each member 14 and can support the speaker 10 on a substantially horizontal surface when the speaker is oriented such that the member 14 is facing the surface (i.e. when the speaker 10 is placed on its side). The feet help to prevent damage to the members 14 and the speaker 10 when the speaker is laying on its side.

Figure 3:
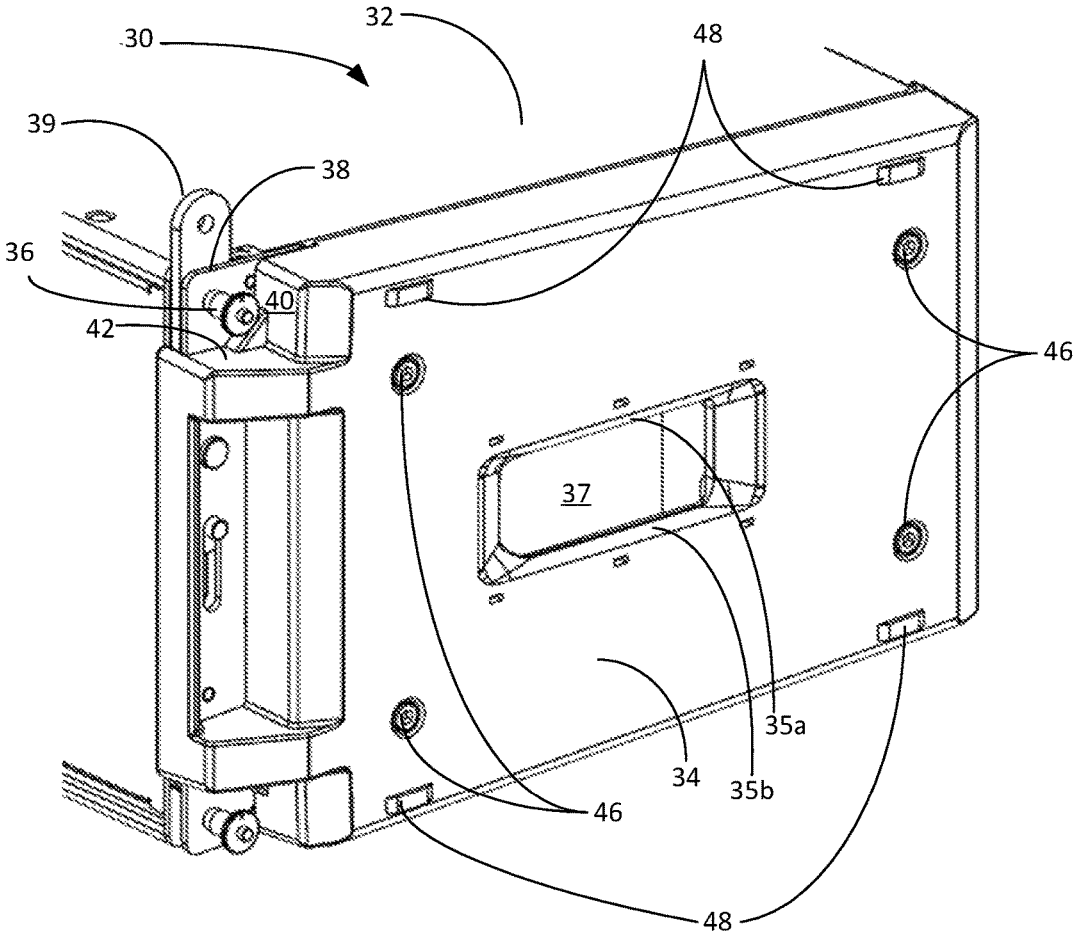
FIG. 3 shows a partial perspective view of a second example of a speaker with an end cap secured to the speaker.
Figure 4:
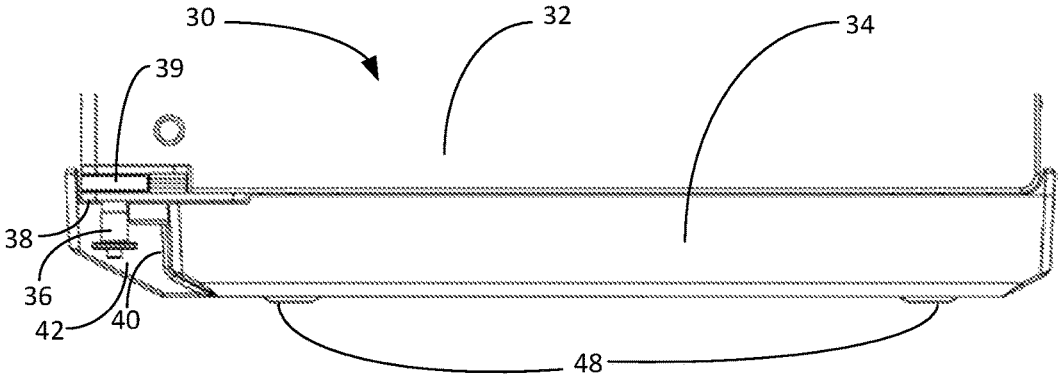
FIG. 4 is a partial top view of FIG. 3.

Turning now to FIGS. 3 and 4, another example of a speaker with an end cap will be described. In this example a speaker 30 is smaller than the speaker 10 and is designed to emit sound waves in the middle and high frequency ranges of human hearing. The speaker 30 includes a housing 32, and an end cap in the form of a member 34, preferably made of plastic, which is secured to the housing. Two substantial differences between the member 34 and each member 14 is that the member 34 (a) defines a pair of handles 35*a* and 35*b* which are unitary and integral with the member 34 and which can be gripped by a human hand to lift the speaker 30 (the speaker can be lifted right side up or upside down), and (b) covers a substantially major portion of an exterior surface 37 of a side panel of the speaker housing to protect the panel from damage.

A locking pin (e.g. a quick pin) 36 passes through a first portion38 of the speaker 30 and through one of a plurality of through holes in an adjustable second portion of the speaker in the form of an attachment bar 39. The bar 39 is used to connect the speaker 30 to another object such as another speaker or a frame.

The member 34 substantially covers at least two sides of the locking pin 36. In this case, surfaces 40 and 42 of the member 34 cover respective sides of the locking pin 36. In other examples a member can be constructed to cover three or all four sides of the locking pin. In this way the member 34 provides some protection against the locking pin 36 unintentionally coming into contact with another object.

The member 34 is releasably secured to the exterior surface 37 of the housing 32 by, for example, a set of four screws 46. The member 34 is used when the speaker 30 will be moved around a lot (e.g. with a traveling band). That is because there is higher risk of the locking pins unintentionally contacting another object. If the speaker 30 will be set up permanently in one location, the member 34 can be removed from the speaker and stored as the risk is lower that the locking pins will unintentionally contact another object.

A set of four feet 48 are secured to the member 34 and can support the speaker 30 on a substantially horizontal surface when the speaker is oriented such that the member 34 is facing the surface (i.e. when the speaker 30 is placed on its side). The feet 48 help to prevent damage to the member 34, the locking pins, and the housing surface 37 of the speaker 30 when the speaker is laying on its side.

A number of implementations have been described. Nevertheless, it will be understood that additional modifications may be made without departing from the scope of the inventive concepts described herein, and, accordingly, other embodiments are within the scope of the following claims.

What is claimed is:

1. A speaker, comprising:

a housing;

a member secured to the housing;

a locking pin which passes through a first portion of the speaker, the member substantially covering at least two sides of the locking pin, whereby the member provides some protection against the locking pin unintentionally coming into contact with another object; and two or more feet which are secured to the member and which can support the speaker on a substantially horizontal surface when the speaker is oriented such that the member is facing the surface.

2. The speaker of claim 1, wherein the member is releasably secured to a side portion of the housing.

3. The speaker of claim 1, wherein the member defines a handle which is unitary and integral with the member and which can be gripped by a human hand to lift the speaker.

4. The speaker of claim 1, wherein the member defines a pair of handles which can alternately be gripped by a human hand, depending on the orientation of the speaker, to lift the speaker.

5. The speaker of claim 1, wherein the member covers a substantially major portion of an exterior surface of a panel of the housing to protect the panel from damage.

6. The speaker of claim 1, wherein the locking pin passes through one of a plurality of through holes in an adjustable second portion of the speaker.

7. An end cap for a speaker, comprising:

a member which can be secured to a speaker housing, the member substantially covering at least two sides of a locking pin which passes through a first portion of the speaker when the member is secured to the housing, whereby the member provides some protection against the locking pin unintentionally coming into contact with another object, wherein the locking pin passes through one of a plurality of through holes in an adjustable second portion of the speaker.

8. The end cap of claim 7, wherein the member is releasably secureable to a side portion of the housing.

9. The end cap of claim 8, further including two or more feet which are secured to the member and which can support the speaker on a substantially horizontal surface when the speaker is oriented such that the member is facing the surface.

10. The end cap of claim 8, wherein the member defines a handle which is unitary and integral with the member and which can be gripped by a human hand to lift the speaker.

11. The end cap of claim 8, wherein the member defines a pair of handles which can alternately be gripped by a human hand, depending on the orientation of the speaker; to lift the speaker.

12. The end cap of claim 8, wherein the member covers a substantially major portion of an exterior surface of a panel of the housing to protect the panel from damage.

13. An end cap for a speaker, comprising:

a member which can be secured to a side of a speaker housing, and two or more feet which are secured to the member and which can support the speaker on a substantially horizontal surface when the speaker is oriented on its side such that the member is facing the surface, wherein the member can substantially cover at least two sides of a locking pin which passes through a first portion of the speaker when the member is secured to the housing, whereby the member provides some protection against the locking pin unintentionally coming into contact with another object.

14. The end cap of claim 13, wherein the member is releasably securable to the side of the speaker housing.

15. The end cap of claim 14, wherein the member defines a handle which is unitary and integral with the member and which can be gripped by a human hand to lift the speaker.

16. The end cap of claim 14, wherein the member covers a substantially major portion of an exterior surface of the side of the speaker housing to protect the housing side from damage.

17. The end cap of claim 13, wherein the locking pin passes through one of a plurality of through holes in an adjustable second portion of the speaker.

* * * * *